United States Patent [19]

Simpson

[11] Patent Number: 4,771,695

[45] Date of Patent: Sep. 20, 1988

[54] LAUNCHING STAND FOR FIREWORKS

[76] Inventor: Richard C. Simpson, Rte. 6, Box 625, Springfield, Mo. 65803

[21] Appl. No.: 45,465

[22] Filed: May 4, 1987

[51] Int. Cl.[4] ..... F42B 4/26

[52] U.S. Cl. ..... 102/343; 102/344; 102/345; 102/347; 102/358; 102/360; 102/361

[58] Field of Search ..... 102/342, 343, 344, 345, 102/349, 351, 358, 360, 361

[56] References Cited

U.S. PATENT DOCUMENTS

| | | | |
|---|---|---|---|
| 1,776,810 | 9/1930 | Holt | 102/358 X |
| 2,129,039 | 9/1938 | Schooley | 102/358 X |
| 2,530,084 | 11/1950 | Schermuly et al. | 102/343 X |
| 3,404,782 | 10/1968 | Ray | 102/343 X |
| 3,485,469 | 12/1969 | Batcheller | 102/343 X |
| 3,611,934 | 10/1971 | Schaefer | 102/343 X |
| 3,862,865 | 1/1975 | McManus et al. | 264/3.3 X |
| 4,148,258 | 4/1979 | Powers | 102/343 X |

*Primary Examiner*—Peter A. Nelson

*Attorney, Agent, or Firm*—Kokjer, Kircher, Bradley, Wharton, Bowman & Johnson

[57] ABSTRACT

A holder for fireworks comprising a pair of rigid uprights of sheet material and a number of rigid plates or shelves of sheet material extending between the uprights. Slots in the respective components provide for assembly into a self-supporting fireworks holder by the relative telescoping of the uprights through the slots. Legs of sheet construction are also telescoped through slots in the upright and interlock with slits in the baseplate to rigidify the structure. Holes in some of the plates hold the fireworks in position for firing. The baseplate is substantially free of holes to serve as a shield to prevent inadvertent ignition of materials proximal to the holder.

10 Claims, 1 Drawing Sheet

LAUNCHING STAND FOR FIREWORKS

This invention relates to pyrotechnic apparatus, and more particularly to a holder for the shooting of fireworks.

Relatively sophisticated equipment is available for the launching of certain aerial pyrotechnics commonly carried out in connection with licensed professional fireworks productions. Such equipment is generally not available to the ordinary person nor is it appropriate for use in the shooting of fireworks generally available to the ordinary, untrained and unlicensed individual.

Fireworks generally available to the average person are those that are classified Class C by Interstate Commerce Commission regulations. These include a wide variety of relatively low power firecrackers, rockets, roman candles and other items. While the explosive power of Class C fireworks is below that of fireworks not generally available to the public, Class C fireworks are still hazardous. They present significant potential for injury and destruction if not properly handled.

The possibility for harm from fireworks can be reduced significantly by utilizing a holder to insure that the fireworks are properly positioned when ignited and during the ensuing discharge. A stand or holder which provides a non-flammable shield at the fire zone can minimize the possibility for an outbreak of fire in the area where the fireworks are ignited and exploded. It can also provide stability which reduces the likelihood that firework projectiles will be fired on errant trajectories from which unintended, harmful consequences may ensue. Personal injuries to the fireworks user and to bystanders can also be avoided or the likelihood for such injuries substantially reduced by a device which insures that the fireworks are properly positioned when ignited.

Heretofore, little if any attention has been paid to the matter of securing the fireworks properly during the ignition phase. Despite the frequency of incidences of injuries and property damages caused by fireworks, little attention has been paid to insuring that fireworks are properly positioned during the critical ignition phase. Most fireworks are sold without any stand or comparable structure suitable for holding the fireworks when they are ignited. Consequently, many are hand held during this phase. Some have integral bases which do little more than permit certain aerial fireworks to be ignited while in a vertical position. Such bases are usually very small and woefully inadequate for insuring that the fireworks remain in proper position through ignition and long enough to insure against hazardous unintended trajectory.

Fireworks commonly termed "bottle rockets" are generally furnished with attached sticks intended for insertion in beverage bottles so that the bottle serves as a firing stand. Bottles, not intended for this purpose, inadequately support such fireworks and their use has led to considerable property damage and some instances of personal injury.

In view of the foregoing, a need exists for apparatus which is capable of safely and reliably supporting fireworks. Accordingly, a primary object of the present invention is to provide structure which fulfills this need.

Another important object of the present invention is to provide an item which is constructed to permit ready disassembly for convenient portability, yet which may be quickly and easily assembled to provide a fireworks support.

A further object of this invention is to provide a support which may be utilized to stabilize and safeguard the firing of a wide variety of fireworks, including all Class C fireworks.

Still another object of the present invention is to provide a fireworks support which may be economically fabricated from readily available materials to insure widespread availability and use of the support to reduce the risks of injury and damages associated with the use of fireworks.

These and other important aims and objectives of the present invention will be further explained or will become apparent from the following description and explanation of the drawing, wherein.

Figures 1, 2, 3, 4:
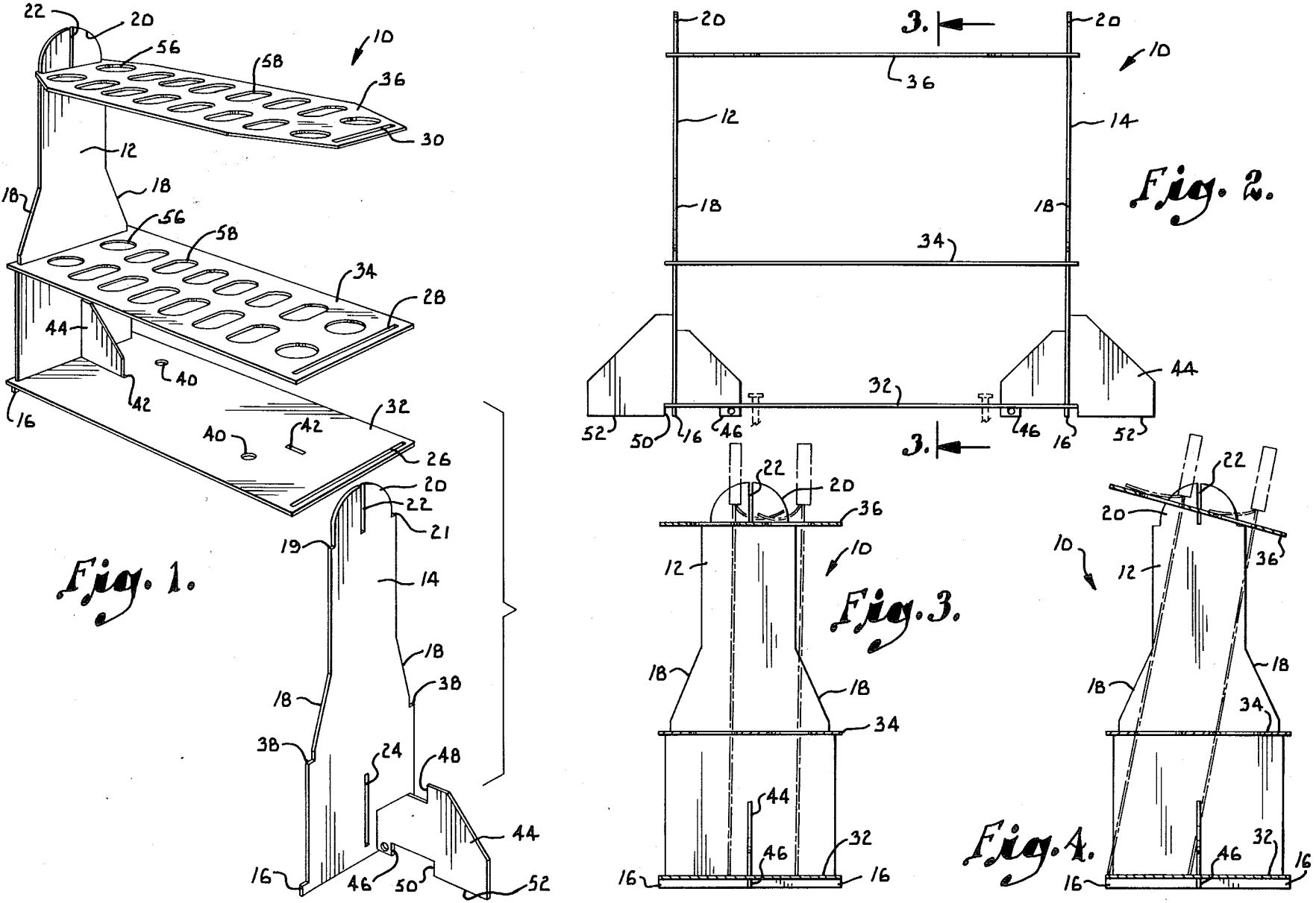
FIG. 1 is a partially exploded, perspective view of a fireworks stand embodying the principles of this invention, one end piece and its associated brace piece being removed from their assembled positions for illustrative purposes.
FIG. 2 is a side elevational view of the stand.
FIG. 3 is a detailed cross-sectional view taken along line 3—3 of FIG. 2, with certain fireworks being shown in phantom to illustrate the use of the stand.
FIG. 4 is a view similar to FIG. 3 but showing the top plate of the stand adjusted to an alternate position to illustrate a use of the stand to aim fireworks to be launched therefrom.

A fireworks launching stand embodying the principles of this invention is broadly designated by the reference numeral 10 in the drawings. Stand 10 includes a pair of rigid, elongated substantially identical uprights 12 and 14. The uprights are constructed of sheet material such as aluminum or the like. Each upright is wider at its bottom than at the top as shown in the drawing. Projections 16 extend outwardly from each edge of each upright at the extreme lowermost end thereof. Inclined shoulders 18 on each side of each upright provide a transition between the vertically extending edges of the relatively wide and the relatively narrow portions of the uprights as shown.

The extreme uppermost end 20 of each upright intermediate a pair of shoulders 19 and 21 is arcuate. A slot 22 communicates with the arcuate edge and extends vertically along the longitudinal axis of the upright as shown. Another vertically extending slot 24 is provided through each upright intermediate the sides of the latter and near the bottom of the upright for a purpose to be described hereinafter.

The uprights are adapted to be received through elongated, transversely extending slots 26, 28 and 30 respectively provided in each end of respective elongated, rigid plates 32, 34 and 36 so that the plates are telescoped over the uprights as shown in the drawing. The slots 26 in plate 32 are sufficiently wide to permit the telescoping of the plate over the uprights with plate 32 resting on the upwardly facing shoulders presented by the outwardly extending projections 16 as shown in FIGS. 2, 3 and 4. Slots 28 in plate 34 may be of a slightly smaller length than slots 26 in plate 32 so that they may rest on shoulders 38 which project outwardly below inclined shoulders 18. Alternatively, if desired, the lengths of slots 28 could be shortened so that plate 34 would engage the inwardly inclined shoulders 18 of the uprights to hold the plate at a predetermined location determined by the lengths of the slots. Slots 30 need be only of sufficient length for telescoping of plate 36 over the relatively narrow upper portions of the uprights with the plate resting on shoulders 19 and 21.

Manifestly, all of the slots 26, 28 and 30 are configured to permit the relative telescoping of the rigid plates along the respective uprights to superposed positions spanning the distance between the uprights and in vertically spaced apart relationship as shown in the drawing. The friction between the plates and the uprights releaseably secures the plates at predetermined positions, yet permits manual adjustment of the positions longitudinally of the uprights as may be required or desired. The uppermost plate 36 preferably has tapered corner edges 38 to minimize the unsupported projection of the plate edges laterally beyond the edges of the uprights and to streamline the appearance of the holder.

Plates 32, 34 and 36 are preferably formed of the same noncombustible sheet material as are uprights 12 and 14 such as sheet aluminum or the like. The lowermost plate 32 is substantially impervious with the exception of a pair of spaced apart, relatively small holes 40 extending through the plate to facilitate the securing of the holder as will be subsequently explained. A pair of small slits 42 extend transversely to slots 26 and spaced inwardly from the latter substantially midway between the side edges of the plate as shown in FIG. 1. The slits 42 cooperate with the slots 24 to receive and lock respective irregularly shaped, rigid, planar brace members 44 configured as shown in the drawings. The members 44 extend through the slots 24 with an integral, downwardly extending projection 46 received in a corresponding slit 42 to interlock the plate to the uprights. The slots 24 are of appropriate length so that shoulders 48 and 50 on member 44 engage the corresponding upright to hold the latter in vertical position and locked in this position by the engagement of projection 46 in its corresponding slot 42. The lowermost edge 52 of the portion of each brace member 44 projecting substantially normal to the major face of its corresponding upright and outwardly therefrom provides leg structure for supporting the holder when the components are assembled as shown in FIG. 2 of the drawing.

Plates 34 and 36 are each provided with a plurality of holes 56 and 58 extending through the plates. In the embodiment illustrated, the holes 56 are circular while the holes 58 are elongated in a direction transverse to the longitudinal axis of the respective plate. Any desired number of holes 56 and 58 may be provided in the plates, the pattern including two rows of staggered holes 58 extending longitudinally of a plate with a pair of circular holes 56 at each end of each plate is presently preferred.

In operation, the components of holder 10 may be packaged and carried with the holder in disassembled condition wherein the components of sheet material occupy very little space and are highly portable. When it is desired to utilize the holder, the components are assembled as heretofore described and as shown in FIG. 2 of the drawing. This presents a highly stable, self-supporting structure from which fireworks of a variety of types may be relatively safely discharged. Preferably, once the location for holder 10 has been chosen, a pair of fasteners such as the nails 60 shown fragmentally in phantom in FIG. 2 are inserted through holes 40 in plate 32 for securing the holder in fixed position on a supporting surface.

The fireworks to be ignited or discharged from the holder are inserted through the holes 56 and/or 58 of plates 34 and 36 or both as may be required to dispose the fireworks in desired positions. The plurality of holes and the shapes of the holes provide a wide variety of options for this purpose. For example, if the fireworks utilized are bottle rockets such as shown in phantom in FIGS. 3 and 4, the holes utilized can be those positioned to maintain the rockets at dispositions to follow trajectories calculated in the interests of safety. Further, a plurality of bottle rockets may be discharged at the same time, the plates 36 serving to hold the fuses of the rockets in positions where they may be ignited individually or simultaneously as desired. FIG. 4 illustrates how the uppermost plate 36 may be adjusted to an angle with respect to horizontal with one end of each slot 30 engaged against the arcuate uppermost edge 20 of the uprights to hold the plate in such angled position. When it is desired that plate 36 be kept in a horizontal disposition, the upwardly facing shoulders 62 proximal the upper end of each upright on each side of the latter provides a shelf for stabilizing the plate in this position.

It should be noted that the elongated holes 58 are particularly desirable for at least two important reasons. First, the elongate shape of these holes permit elongated, rigid fireworks such as roman candles or the like to be installed through the holes at an angle. The hole width may be only slightly larger than the firework diameter to provide a relatively snug fit for securing the firework position. The additional length of hole, nevertheless, permits the firework to be canted at an angle from vertical in the holder if desired.

A second important reason for the elongated holes is to permit the transverse tilting of the plates, such as the tilting of plate 36 illustrated in FIG. 4, if desired, when a plurality of elongated fireworks are to be held in the holder at one time for simultaneous firing, it will probably be desirable to have the various fireworks held in a variety of angles. The elongated holes provide enhanced versatility in this respect.

All types of Class C fireworks may be accommodated by holder 10. Firecrackers and the like can be supported on any of the plates 32, 34 and 36. When it is desired to simultaneously discharge a number of fireworks such as firecrackers, the vertically extending slots 22 communicating with the upper edge of the uprights may be utilized to receive the fuses of the fireworks to hold them together for simultaneous ignition. Such fireworks as roman candles and the like can be inserted through aligned holes in plates 36 and 34 with the lowermost ends of the fireworks supported on the baseplate 32. The impervious baseplate is always in position to serve as a shield for products of combustion emanating from the fireworks to prevent the inadvertent ignition of materials in the proximity of the holder. In the manner heretofore described with respect to bottle rockets, sparklers, roman candles and the like can be securely held by the holder 10 in positions calculated to minimize the possibility or mishap due to discharge of the fireworks when improperly positioned.

When it is desired to move the holder to an alternate location or to pack the holder for storage, the respective components may quickly and easily disassemble by separation. Again, the sheet material construction of each component facilitates the convenient packing and carrying the holder. Further, the holder is highly portable for movement from place to place without disassembly if desired. The novel construction utilizing relatively telescoped sheet components throughout, which components are interlocked in a unique arrangement, provides a highly stable and safe launching device for the ignition of explosive articles in the nature of fireworks to minimize the hazards associated therewith and yet to enhance the pleasure to be derived therefrom.

Having thus described the invention, I claim:

1. A holder for the firing of fireworks comprising:

a pair of spaced apart uprights;

a substantially impervious baseplate of non-flammable material releaseably secured to the uprights and spanning the distance therebetween;

at least one cross-member carried by the uprights and spanning the distance therebetween in vertically spaced disposition over the baseplate; and means carried by the cross-member and adapted to engage fireworks supported by the holder for holding the fireworks in predetermined disposition relative to the baseplate during the firing of the fireworks whereby the baseplate is in position for receiving products of combustion during the firing of the fireworks to shield against inadvertent ignition of materials in the proximity, wherein said cross-member comprises a plate of non-flammable material and wherein said plate is secured to said uprights by adjustable means operable to permit the selective adjustment of the major plane of the plate to any of a variety of angles with respect to horizontal to permit adjustment of the positions of said fireworks during the firing thereof.

2. A holder as set forth in claim 1, wherein said holding means includes at least one hole through said plate.

3. A holder as set forth in claim 2, wherein said holding means includes a plurality of holes through said plate.

4. A holder as set forth in claim 3, wherein said plate is elongated, and wherein at least some of said holes are elongated, the longitudinal axes of said elongated holes being substantially normal to the longitudinal axis of said plate.

5. A portable holder for the firing of fireworks comprising:

a pair of elongated, rigid uprights;

a plurality of rigid plates of non-flammable material;

releaseable securing means operable with the plates and said uprights for securing the plates at predetermined locations intermediate the ends of the uprights whereby the plates and the uprights may be assembled into a self-supporting structure with the respective plates extending between the uprights in superposed, vertically spaced apart relationship and maintaining the uprights in their upright positions, said securing means including a slot through each end of each plate respectively, the slots being configured to receive a corresponding upright therethrough, each upright including abutment means carried by the upright and engageable by said plates for maintaining the latter in said vertically spaced apart, superposed relationship; and at least one of said plates having a hole extending therethrough to permit the telescoping of an elongated firework through the hole to hold the firework in position for firing.

6. A holder as set forth in claim 5, wherein said abutment means includes a plurality of shoulders on the edges of said uprights in disposition to be engaged by the respective plates for holding the latter in said relationship.

7. A holder as set forth in claim 5, wherein one of said plates is substantially impervious whereby to provide a shield to prevent inadvertent combustion of materials in the proximity of the holder during firing of said fireworks.

8. A holder as set forth in claim 5, wherein each upright is provided with a longitudinally extending slot proximal the lowermost end of the upright, and wherein the holder includes a rigid, planar brace member for each upright respectively, each brace member being received in telescoped relationship through its corresponding slot and extending generally normal to the major plane of the corresponding upright to brace the latter in said upright position.

9. A holder as set forth in claim 8, wherein each brace member includes means engageable with its corresponding upright and with one of said plates for securing the upright in predetermined angular relationship with respect to the plate, whereby to rigidify the self-supporting structure.

10. A holder as set forth in claim 9, wherein each upright is provided with a slot proximal the upper end of the upright and communicating with the edge of the upright for receiving fireworks fuses in said slot to hold the latter in position to be ignited while the fireworks are positioned by the holder.

* * * * *